US011585057B2

(12) United States Patent
Pierson et al.

(10) Patent No.: US 11,585,057 B2
(45) Date of Patent: Feb. 21, 2023

(54) TRANSITION BARRIER FOR CONNECTING A PERMANENT BARRIER TO A TEMPORARY BARRIER

(71) Applicants: AMG METALS, INC., Newmarket (CA); POWELL (RICHMOND HILL) CONTRACTING LIMITED, Gormley (CA); THE TEXAS A&M UNIVERSITY SYSTEM, College Station, TX (US)

(72) Inventors: John David Pierson, Newmarket (CA); Ben Powell, Sharon (CA); Nauman Mansoor Sheikh, Houston, TX (US)

(73) Assignees: AMG METALS, INC., Newmarket (CA); POWELL (RICHMOND HILL) CONTRACTING LIMITED, Gormley (CA); THE TEXAS A&M UNIVERSITY SYSTEM, College Station, TX (US)

( * ) Notice: Subject to any disclaimer, the term of this patent is extended or adjusted under 35 U.S.C. 154(b) by 1029 days.

(21) Appl. No.: 16/318,751

(22) PCT Filed: Jul. 17, 2017

(86) PCT No.: PCT/CA2017/050859
§ 371 (c)(1),
(2) Date: Jan. 18, 2019

(87) PCT Pub. No.: WO2018/014121
PCT Pub. Date: Jan. 25, 2018

(65) Prior Publication Data

US 2019/0242080 A1 Aug. 8, 2019

(30) Foreign Application Priority Data

Jul. 19, 2016 (CA) ..... CA2936510

(51) Int. Cl.
*E01F 15/02* (2006.01)
*E01F 15/08* (2006.01)
*E01F 15/04* (2006.01)

(52) U.S. Cl.
CPC ..... *E01F 15/025* (2013.01); *E01F 15/0423* (2013.01); *E01F 15/0438* (2013.01); *E01F 15/083* (2013.01)

(58) Field of Classification Search
CPC ... E01F 15/088; E01F 15/025; E01F 15/0438; E01F 15/145; E01F 15/083; E01F 15/146; E01F 15/0446; E01F 15/0423
See application file for complete search history.

(56) References Cited

U.S. PATENT DOCUMENTS 4,406,563 A 9/1983 Urlberger
4,815,565 A * 3/1989 Sicking ..... E01F 15/146 256/1

(Continued)

FOREIGN PATENT DOCUMENTS

DE 202006015432 U1 2/2007
DE 202006015433 U1 2/2007

(Continued)

OTHER PUBLICATIONS

International Search Report for PCT/CA2017/050859 dated Oct. 5, 2017.

(Continued)

*Primary Examiner* — Matthew R McMahon
(74) *Attorney, Agent, or Firm* — Potomac Law Group, PLLC; Joseph Murphy

(57) ABSTRACT

A transition barrier for transitioning from a permanent median barrier to a temporary median barrier, the transition barrier having: a) a first end; the first end being connectable to the permanent median barrier by a permanent median (Continued)

barrier connector; b) a second end; the second end being connectable to the temporary median barrier by a temporary median barrier connector; c) a transition section defining a transition wall of a predetermined length between the first end and the second end; the transition wall having a top, bottom, front and a back; d) at least one barrier brace proximate the transition wall, for supporting said transition wall; and e) at least one spacer, proximate the back of the transition wall for contact with a surface of the permanent concrete barrier.

34 Claims, 17 Drawing Sheets

(56) References Cited

U.S. PATENT DOCUMENTS

| | | | | |
|---|---|---|---|---|
| 5,314,261 | A * | 5/1994 | Stephens | E01F 15/145 256/13.1 |
| 5,527,127 | A | 6/1996 | Junker | |
| 5,860,762 | A * | 1/1999 | Nelson | E01F 15/083 404/6 |
| 6,024,341 | A * | 2/2000 | Gertz | E01F 15/146 256/1 |
| 6,712,545 | B2 | 3/2004 | Muller et al. | |
| 6,926,461 | B1 * | 8/2005 | Faller | E01F 15/086 404/6 |
| 7,059,590 | B2 * | 6/2006 | Bronstad | E01F 15/083 256/13.1 |
| 7,410,320 | B2 * | 8/2008 | Faller | E01F 15/145 404/6 |
| 2002/0000543 | A1 * | 1/2002 | Arthur | E01F 15/083 256/13.1 |
| 2002/0024043 | A1 * | 2/2002 | Albritton | E01F 15/143 256/13.1 |
| 2003/0081997 | A1 * | 5/2003 | Kramer | E01F 15/145 404/6 |
| 2006/0045617 | A1 * | 3/2006 | Faller | E01F 15/145 404/6 |
| 2006/0072967 | A1 | 4/2006 | Sasse | |
| 2009/0202296 | A1 * | 8/2009 | Lamore | E01F 13/06 404/6 |
| 2016/0060832 | A1 | 3/2016 | Alberson et al. | |

FOREIGN PATENT DOCUMENTS

| | | | | |
|---|---|---|---|---|
| DE | 202006017431 | U1 | 2/2007 | |
| DE | 102008056807 | A1 | 5/2010 | |
| EP | 2034094 | B1 | 3/2009 | |
| EP | 2213800 | A1 | 8/2010 | |
| EP | 2336427 | A2 | 6/2011 | |
| EP | 2339071 | B1 | 6/2011 | |
| KR | 100538994 | B1 * | 9/2005 | E01F 15/0423 |
| WO | 2004009909 | A1 | 1/2004 | |
| WO | 2007103138 | A2 | 9/2007 | |

OTHER PUBLICATIONS

Abstract of EP2339071A1.
Abstract of EP2336427A2.
Abstract of EP2034094B1.
Abstract of EP2020460B1.
Abstract of EP2213800A1.
AbstractofDE202006017431U1.
Extended European Search Report dated Apr. 15, 2021 for European Patent Application No. 17830144.

* cited by examiner

TRANSITION BARRIER FOR CONNECTING A PERMANENT BARRIER TO A TEMPORARY BARRIER

CROSS-REFERENCE TO RELATED APPLICATIONS

This application is a U.S. National Phase Application of PCT/CA2017/050859, filed Jul. 17, 2017, which claims priority to Canadian Patent Application No. 2936510, filed Jul. 19, 2016, the contents of which applications are incorporated herein by reference in their entireties for all purposes.

FIELD OF THE DISCLOSURE

This disclosure relates to a transition barrier for connecting a permanent barrier to a temporary barrier. More particularly this disclosure relates to a transitional barrier for use when connecting a permanent road barrier to a temporary road barrier. This is particularly useful in situations where roadwork is conducted and/or road signs are erected (for example the road sign support system described in PCT/CA2016/050585) and also useful in temporary transition barriers.

BACKGROUND

One existing transition barrier consists of a 4950 mm long steel channel running the length of the transition between a permanent concrete barrier and a temporary concrete barrier with two 6610 mm long steel beam guide rails (SBGR) (one steel beam guide rail fitted matingly atop the other) running the length of the transition and secured onto the steel channel (acting as a stiffener) via 16 mm diameter bolts at 950 mm intervals along the length of the steel channel. The existing system also includes a second 6610 mm long steel channel running the length of the transition just below the two SBGR. One end of each of the i) two 6610 mm long SBGR and ii) 6610 long steel channel running just below the two SBGR is secured onto the permanent concrete barrier with anchor bolts and the other end of each of the i) two 6610 mm long SBGR and ii) 6610 long steel channel running just below the two SBGR is secured onto the temporary concrete barrier with anchor bolts. Experience has shown that the above system is not rigid enough, and creates a pocket in the rail during impact by a vehicle, causing the vehicle to spin around or stop suddenly. Furthermore, if deflection of the vehicle occurs, deflection may cause the temporary transition wall to buckle, or cause the vehicle to snag on the temporary transition wall rather than be re-directed. Both results may cause serious injury to the occupant(s) of the vehicle and/or result in a secondary collision.

Other transition barriers include US 2006/0072967, EP 2020460 B1, EP 2213800 and US 2016/0060832.

There is a need for a transition barrier that may be temporary and/or permanent. There is a need for a temporary transition barrier that mitigates vehicle spin around and/or flip over, during collision into a temporary transition barrier. There is also need for a temporary transition barrier that minimizes deflection upon impact. There is also a need for a temporary transition barrier that complies with the Manual for Assessing Safety Hardware (MASH). MASH is part of the American Association of State Highway and Transportation Officials (AASHTO). MASH provides evaluation techniques for the crash testing of safety hardware devices for use on the National highway System (NETS). MASH presents uniform guidelines for crash testing permanent and temporary highway safety features and recommends evaluation criteria to assess test results. The MASH report is available at bookstore.transportation.org. There is also a need for a temporary transition barrier useful with a road sign support system.

SUMMARY

According to one aspect, there is provided a transition barrier, preferably a temporary transition barrier, for transition between two median barriers, preferably for transition from a permanent median barrier to a temporary median barrier, said transition barrier comprising:

i) A first end; said first end being connectable to said permanent median barrier; In one embodiment said first end further comprising a permanent median barrier connector for connecting said first end to said permanent barrier. Preferably said permanent median barrier connector allowing for an approach angle of said transition barrier from about 0 to about 10 degrees from centerline of said permanent median barrier. Preferably said approach angle is less than about 6 degrees, preferably about 5.7 degrees, more preferably less than about 5 degrees, even more preferably about 4 degrees, more preferably about 3 degrees (preferably 3.1 degrees). Preferably said permanent median barrier connector allowing for disconnection of said first end from said permanent median barrier, as desired. In one embodiment, said permanent median barrier connector is at least one anchor, preferably a concrete anchor, preferably a plurality of anchors, preferably a plurality of concrete anchors, each of said anchors having a low-profile, non-snagging head for mitigating snagging of sheet metal of a vehicle during impact onto said temporary transition barrier;

ii) A second end; said second end being connectable to a temporary median barrier. In one embodiment, said second end further comprising a temporary median barrier connector for connecting said second end to said temporary median barrier. In one embodiment, said temporary median barrier connector allowing for disconnection of said second end from said temporary median barrier, as desired. In one embodiment, said temporary median barrier connector is at least one concrete anchor, preferably a plurality of concrete anchors; more preferably a cross bolt system. In a preferred embodiment, said temporary median barrier is a 32 inch Tall x-bolt median barrier with cut-out as per Ministry of Transportation Ontario MTOD-911.191 July 2015 Rev. 0;

iii) A transition section defining a transition wall of a predetermined length between said first end and said second end. Said transition wall having a top, bottom, front and a back. Preferably said wall having a profile shape of a wall profile of said permanent median barrier. Preferably said transition wall being steel, more preferably said transition wall being a steel plate. Preferably said steel plate being galvanized.

iv) At least one barrier brace proximate said transition wall, for supporting said transition wall; preferably proximate said back of said transition wall; preferably a plurality of barrier braces; more preferably a plurality of spaced apart barrier braces; even more preferably said at least one barrier brace and/or said plurality of spaced apart barrier braces is/are horizontally disposed. In one embodiment, said at least one barrier brace runs a predetermined horizontal length of said transition wall; preferably said at least one barrier brace runs a substantial horizontal length of the transition wall wherein a first end of said at least one barrier brace is proximate said first end of said transition barrier and a second end of said at least one barrier brace is proximate said second end of said transition barrier. Preferably said plurality of barrier braces run a predetermined horizontal length of the transition wall. In another embodiment, said at least one barrier brace is integral with said back of said transition wall; preferably said plurality of barrier braces are each integral with said back of said transition wall; more preferably said plurality of said spaced apart barrier braces are each integral with said back of said transition wall. Preferably said at least one barrier brace is position on said transition wall at a height substantially equivalent to the height of a standard bumper of a vehicle.

v) At least one spacer, preferably a plurality of spacers, proximate the back of said transition wall for contact with a surface of said permanent concrete barrier. In one embodiment said at least one spacer is fixed in length. In another embodiment, said at least one spacer is adjustable in length, to accommodate permanent concrete barriers of varying thicknesses and varying distances between the transition barrier and the permanent concrete barrier. Preferably said adjustable spacer further comprises a contact plate for contacting said surface of said permanent concrete barrier. In a preferred embodiment, said plurality of spacers are a combination of fixed in length spacers and adjustable in length spacers. More preferably, said at least one spacer fixed in length is proximate said first end of said temporary transition barrier and said at least one adjustable in length spacer is proximate said second end of said temporary transition barrier. Said spacers serving to strengthen the transition barrier by transferring impact load from the transition wall to the permanent concrete barrier during a collision; preferably from the transition wall to the at least one barrier brace to the at least one spacer and to the permanent concrete median barrier. Furthermore, said at least one adjustable in length spacer may be adjusted to achieve a compression fit between the transition barrier and the permanent median barrier minimizing deflection during impact. Preferably, each of said spacers (fixed and adjustable) being securely attached to the transition wall, requiring no modification for placement against the permanent median barrier.

According to yet another embodiment, said at least one spacer is adjustable in position along said at least one barrier brace. Preferably said at least one spacer is adjustable along the horizontal length of said at least one barrier brace.

According to yet another embodiment, said at least one space is a tube. In one embodiment a resilient tube. In embodiment, an inflexible tube. Preferably said tube having a height similar to the transition wall. In another embodiment said tube having a height similar to the median barrier (preferably said permanent median barrier). Said tube is adjustable along said barrier brace to provide a snug fit between said transition section (preferably transition wall) and said median barrier (preferably said permanent median barrier).

According to yet another aspect, there is provided the use of a transition barrier, preferably a temporary transition barrier, as described herein, with a permanent median barrier and a temporary median barrier.

According to yet another aspect, there is provided a method of forming a transition barrier, preferably a temporary transition barrier, between two median barriers, preferably between a permanent median barrier and a temporary median barrier, said method comprising connecting the transition barrier as described herein to said median barriers, preferably said first end of said transition barrier to one median barrier and said second end of said transition barrier to another median barrier, more preferably connecting a first end of said transition barrier to a permanent median barrier and a second end of said transition barrier to said temporary median barrier, respectively.

In a preferred embodiment, the permanent median barrier is a New Jersey Concrete Safety Shape Barrier (also known as NJ-shape, Jersey and NJ barrier) known to persons of skill in the art. In a preferred embodiment, the transition wall of the temporary transition barrier has a profile of a NJ-shape barrier. The NJ barrier has a profile with a lower wall portion having a sloped face of 55 degrees from the road surface followed by an upper wall portion having a sloped face of 84 degrees from the road surface. Typically, for shallow-angle hits, the vehicle tires ride up on the lower sloped face. The intention being to minimize damage to the sheet metal of a vehicle during a collision with the barrier. For higher impact angles, typically, the front bumper of a vehicle impacts the upper sloped face and slides upwards on the barrier lifting the vehicle. If the bumper is relatively weak, the front end starts to crush before any uplift occurs. Then, as the vehicle becomes more nearly parallel with the barrier, the wheel contacts the lower sloped face of the barrier lifting the vehicle enough to reduce the friction between the tires and the paved surface and assisting in banking and redirecting the vehicle.

Even more preferably, the permanent median barrier is an F-shape barrier. The one difference between the F-shape barrier and the NJ barrier is the distance from the ground to the slope break is 330 mm in NJ barriers, versus 255 mm for F-shape barriers. An F-shaped barrier is not shaped like the letter "F". F-shape resulted from a study in which various configurations of NJ barriers were labeled A through F, with F being the preferred design. The F-shape barrier has a 75 mm vertical face at the pavement surface and breaks to a sloped face rising to a height of 255 mm at an angle of 55 degrees, and then transitions to a substantially vertical face (84 degrees) to the top of the barrier. The F-shape barrier is also slightly thicker at the top of the wall (229 mm) versus 152.5 mm of the NJ barrier.

According to one embodiment, the transition wall has an F-shape barrier profile.

Even yet more preferably, the permanent median barrier is a 1049 mm Tall Wall New Jersey concrete barrier and the temporary median barrier is a pre-cast F-shape concrete barrier. Preferably the temporary median barrier is secured to a road surface, more preferably the temporary median barrier is secured to a road surface along one side of said temporary median barrier, preferably pinned-down to a road surface. More preferably a pre-cast F-shape concrete barrier is secured to a road surface, preferably pinned-down, more preferably pinned-down to asphalt with a drift pin, preferably a plurality of drift pins, more preferably a plurality of steel drift pins, wherein each of said steel drift pins are preferably of a length and configuration meeting the Ministry of Transportation Ontario Drawing (MTOD) 911 162 January 2010. Preferably the pre-cast F-shape concrete barrier is pinned-down along one side thereof.

According to yet another embodiment, the transition wall has a 1049 mm Tall Wall New Jersey concrete barrier profile.

According to another aspect, there is provided a temporary transition barrier as described herein which is Manual for Assessing Safety Hardware (MASH) compliant and/or Canadian Highway Bridge Design Code compliant for at least one of wind, seismic and environmental loading. Preferably said temporary transition barrier is MASH compliant for MASH tests 3-20 and 3-22.

MASH is part of the American Association of State Highway and Transportation Officials (AASHTO). MASH provides evaluation techniques for the crash testing of safety hardware devices for use on the National Highway System (NHS). MASH presents uniform guidelines for crash testing permanent and temporary highway safety features and recommends evaluation criteria to assess test results. The MASH report is available at bookstore.transportation.org.

The Canadian Highway Bridge Design Code and the AASHTO apply to the design, evaluation, and structural rehabilitation design of fixed and movable highway bridges including provisions for the design of barriers, highway accessory supports of a structural nature, such as lighting poles, and sign support structures.

According to yet another aspect, there is provided a pair of transition barriers as described herein, preferably temporary transition barriers, for use on a road surface having at least two directions of traffic flow, typically separated by a permanent median barrier, wherein one of said pair of transition barriers is erectable along one traffic flow direction and another of said pair of transition barriers is erectable along another traffic flow direction.

According to yet another aspect, there is provided a transition barrier, preferably a temporary transition barrier, as described herein in combination with a support system, preferably a sign support system, more preferably a sign support system as described in our co-pending application CA 2,892,412. Preferably when in combination with a support system, there are at least two transition barriers, preferably at least two temporary transition barriers, as described herein, more preferably a temporary transition barrier one either side of the support system.

Further and other aspects will become apparent upon reading the following detailed description.

DETAILED DESCRIPTION

Figure 1:
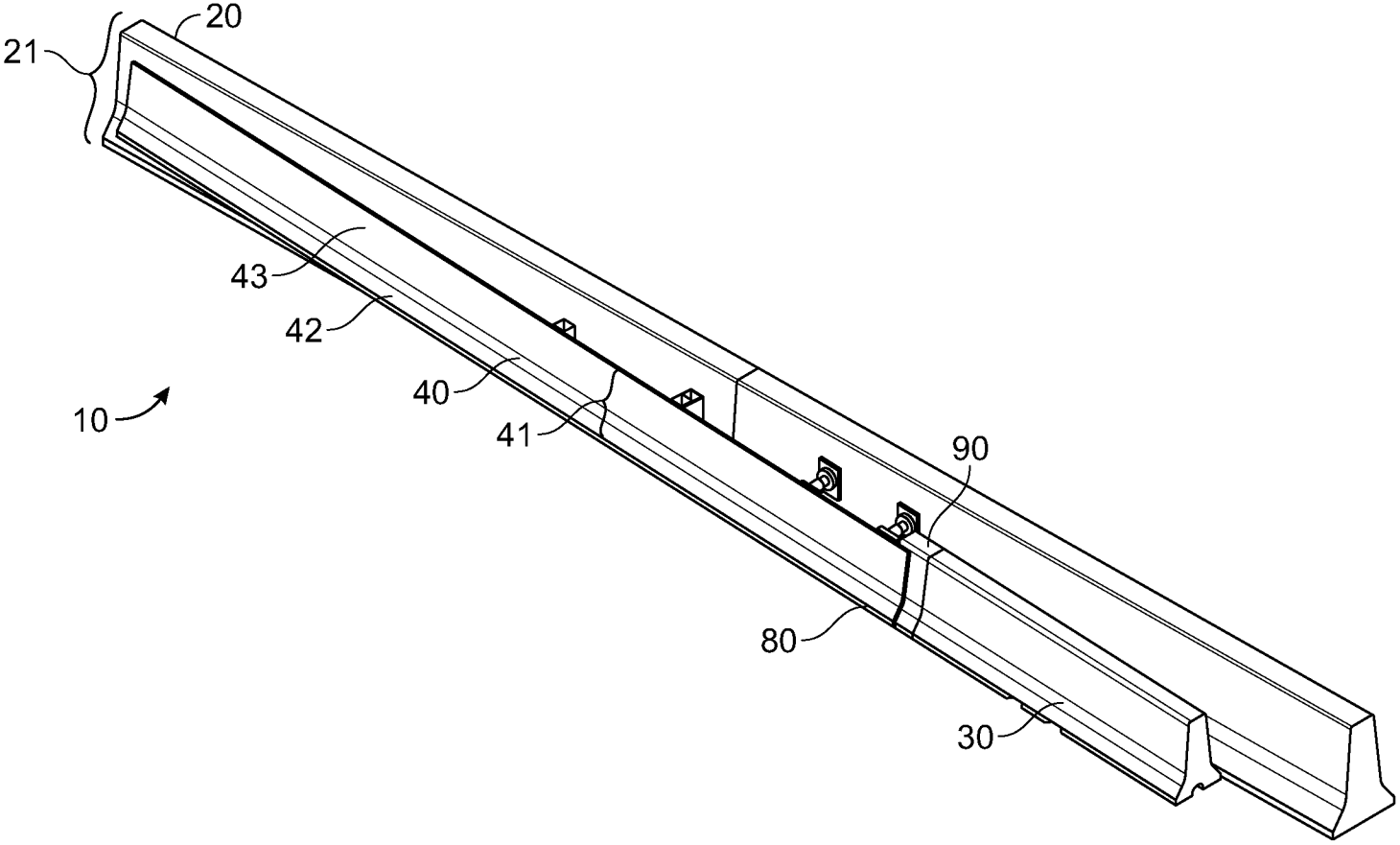
FIG. 1 is a perspective view of the transition barrier according to one preferred embodiment
Figure 2:
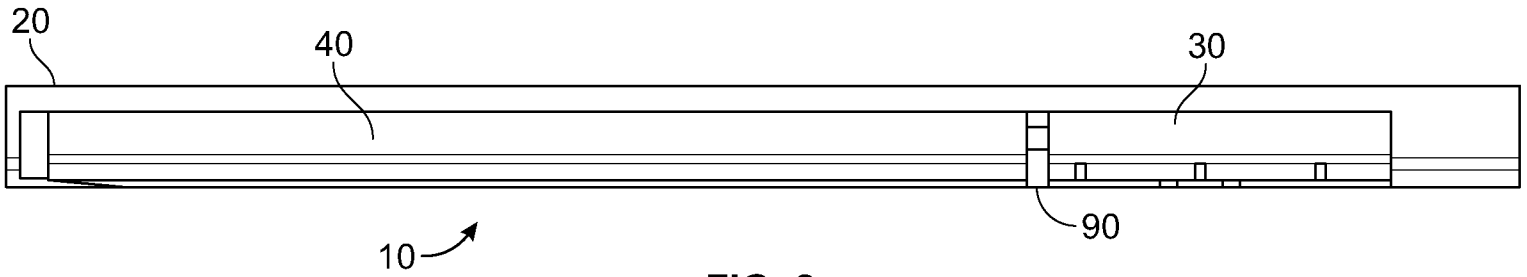
FIG. 2 is a front view of the transition barrier of FIG. 1

Referring now to the Figures, there is shown a transition barrier 10, connected at a first end to the surface of a permanent concrete median barrier 20 and connected at a second end to the end of a temporary concrete median barrier 30. The permanent concrete median barrier 20 in this case is a New Jersey Tall Wall keyed-in barrier. The temporary concrete median barrier 30 in this case is a 32-inch Tall X-bolt (or cross bolt) barrier with cutout. The transition barrier 10 has a transition wall 40 with an outer profile 41 resembling the profile 21 of the permanent concrete median barrier 20 being the New Jersey Tall Wall keyed-in barrier. The outer profile 41 consists of a lower sloped wall 42 transitioning to a higher sloped wall 43. The transition wall 40 is made of steel. It may be made of a number of steel plates suitably joined together at the ends thereof or it may be a single steel plate. If joined together at the ends thereof, the joining technique should be one in which the joined plates will behave as a single steel plate.

Figure 3A:
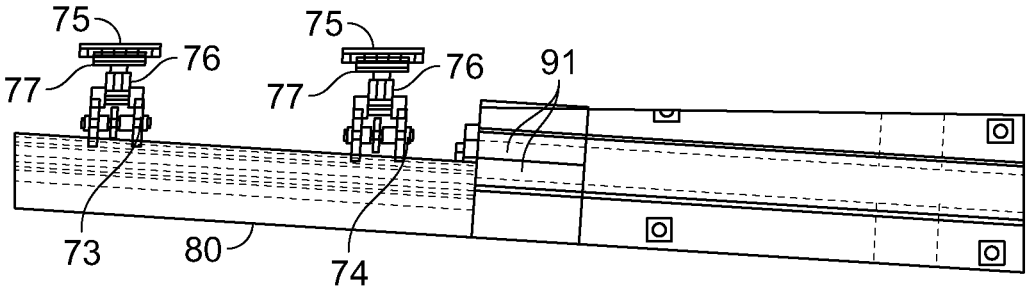
FIGS. 3A-3D are a cut away view of the transition barrier of FIG. 1 from the end of the temporary barrier
Figure 3B:
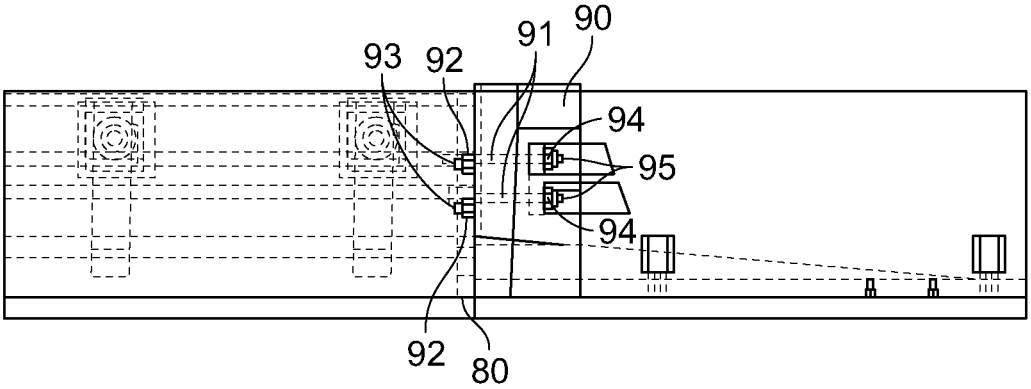
Figure 3C:
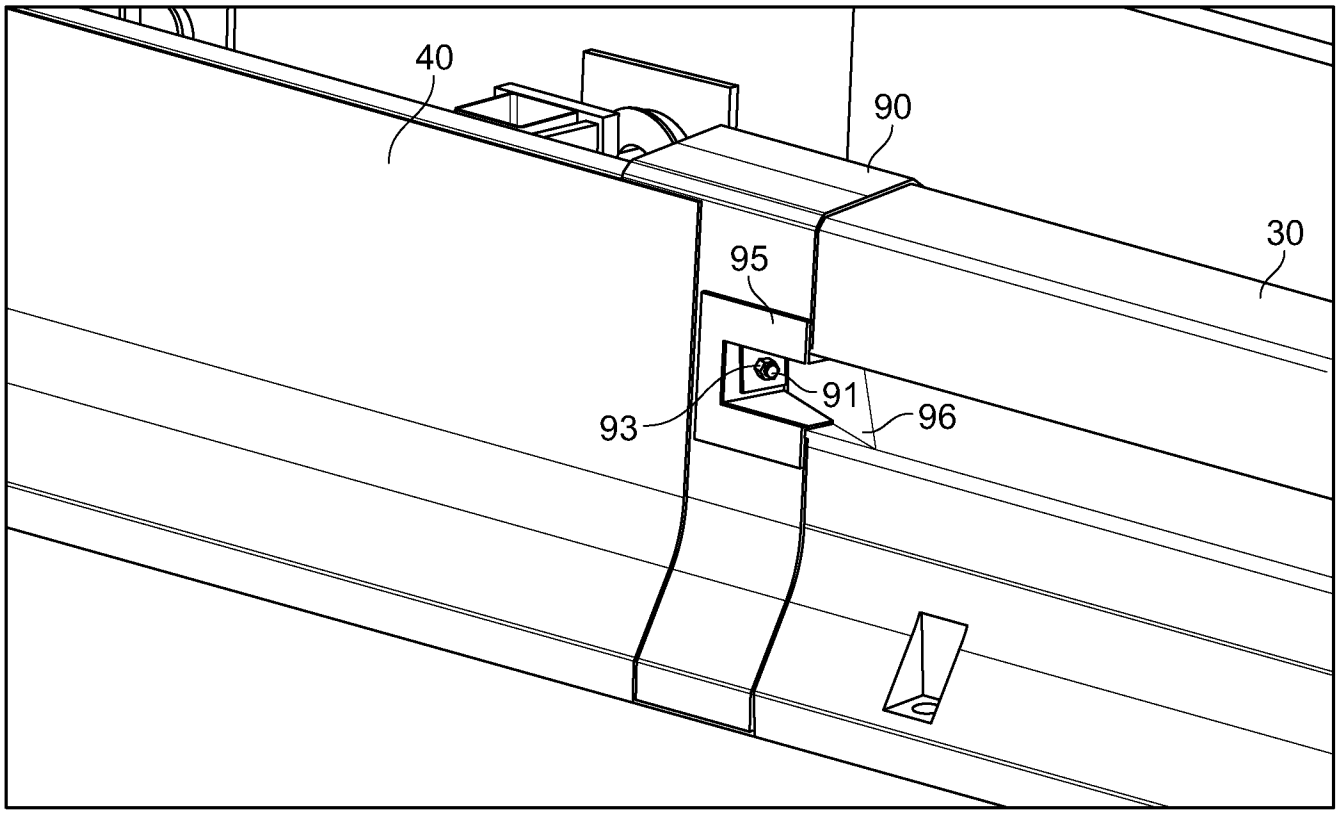
Figure 3D:
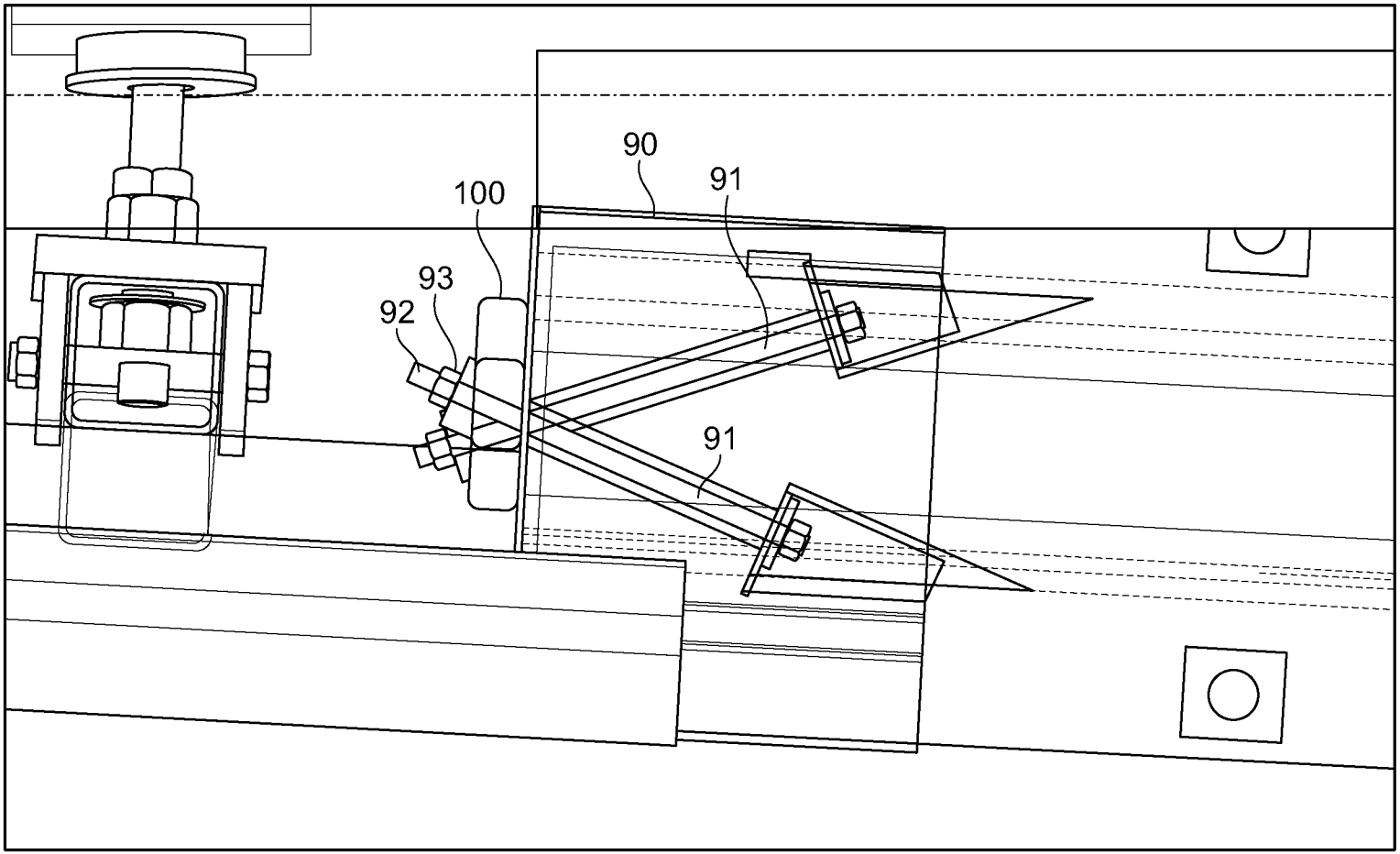
Figure 4A:
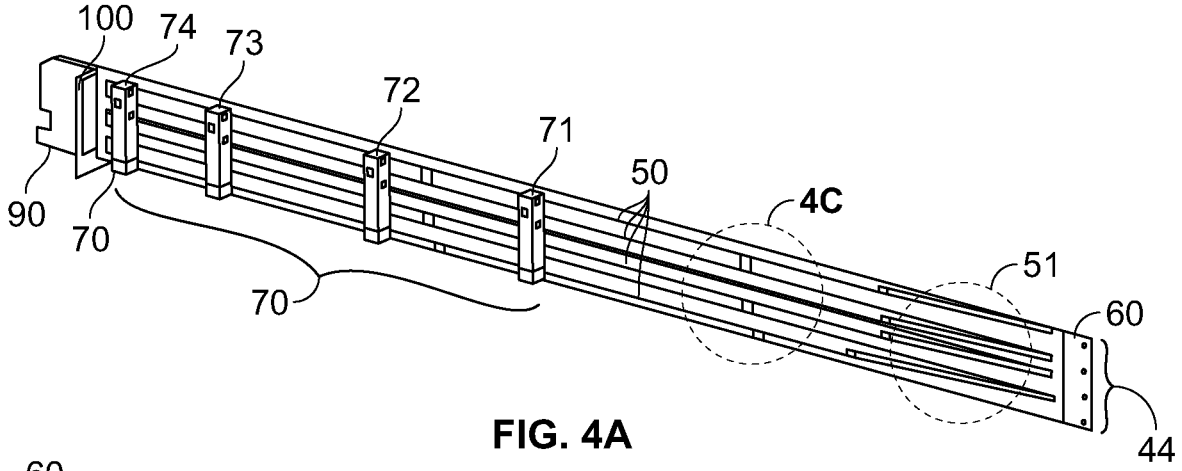
FIGS. 4A and 4B is a rear and perspective view respectively of the transition barrier of FIG. 1 without the adjustable spacers.
Figure 4B:
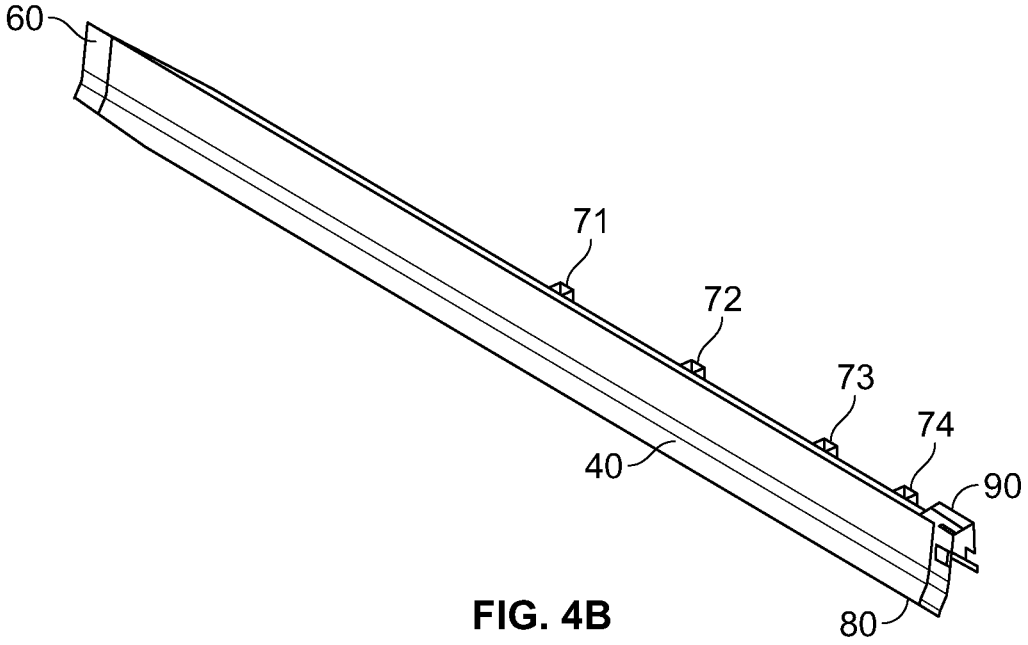
Figure 4C:
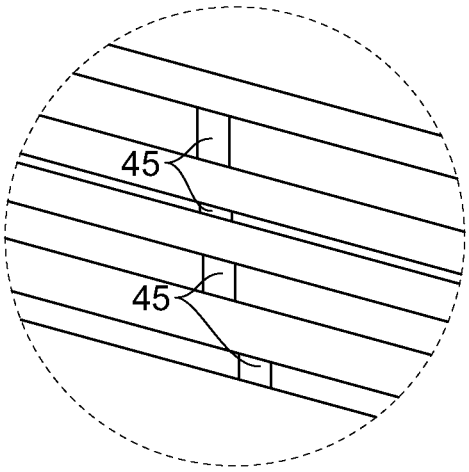
FIG. 4C is an exploded view of a section of FIG. 4A
Figure 5:
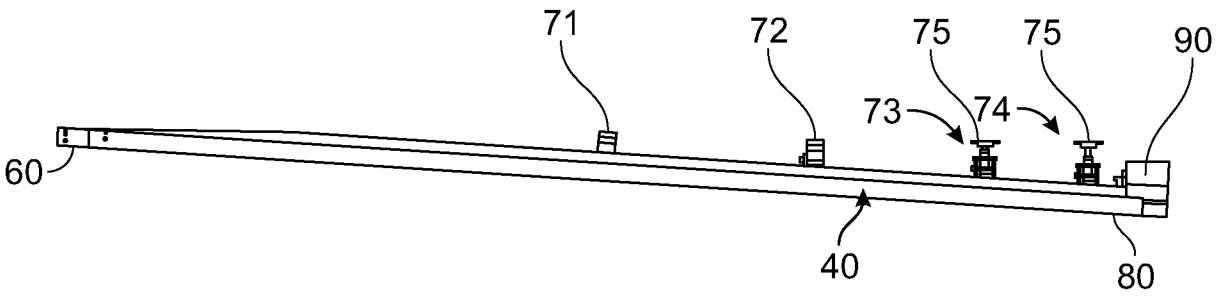
FIG. 5 is a top view of the transition barrier of FIG. 1
Figure 8A:
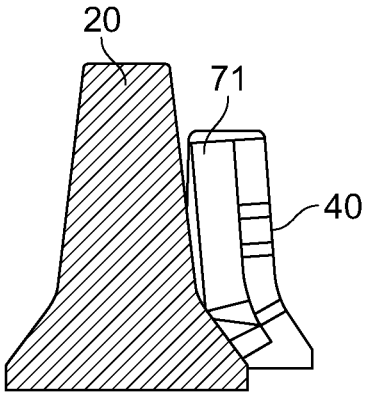
FIGS. 8A-8C are side views of the spacers according to one embodiment
Figure 8B:
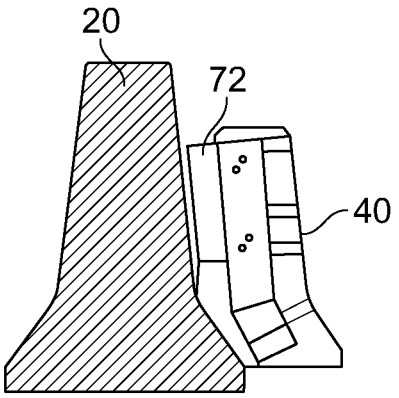
Figure 8C:
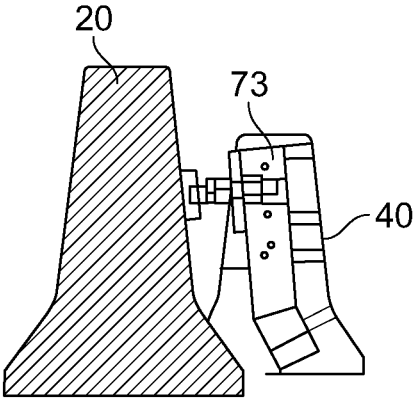

The transition wall is further rigidified by a number of spaced apart horizontal braces 50 (FIG. 4A) on the inner profile 44 thereof. At the first end 60 of the transition wall 40, each of said horizontal braces is tapered 51 downwards to the first end 60 to reduce the transition angle between the transition wall 40 and the permanent concrete median barrier 20. In this instance, the transition angle is 3.1 degrees. Each of said horizontal braces 50 is a HSS (hollow structural section) with a hollow rectangular tubular cross section (although other suitable cross sections may be used) made of structural steel grade ASTM A500C. In this embodiment, there are four horizontal braces 50. The top three of said horizontal braces are made of HSS 4×2×0.25 inches No. 1 and are positioned on the inner profile 44 of the higher sloped wall 43. The fourth of said horizontal braces is made of HSS 4×2×0.25 inches No. 2 and is position on the inner profile 44 of the lower sloped wall 42. Each of said horizontal braces 50 is welded onto the inner profile 44 of the transition wall 40. In this embodiment, given the transition wall comprises a number of steel plates, the transition wall 40 includes a number of backing plates 45 (FIG. 4C) between each of the spaced apart horizontal braces 50. Each of said backing plates is welded onto the inner profile 44 of the transition wall. The backing plates 45 serve to obtain optimal (preferably 100%) penetration welds to structurally simulate a single steel plate for the transition wall 40. At predetermined positions, the inner profile 44 of the transition wall 40 includes a number of spaced apart vertical braces 70. In this embodiment there are four spaced apart vertical braces 70. Each of said vertical braces 70 is made of HSS 6×6×0.313 inches. Each of said spaced apart vertical braces 70 is of a hollow rectangular tubular cross section (although other cross sections may be used). Each of said spaced apart vertical braces 70 is welded onto each of the horizontal braces 50. The first vertical brace 71 (FIG. 5, FIG. 6, FIG. 7B, FIG. 8A) proximate the first end 60 serves as a non-adjustable spacer to sit against the surface of the permanent concrete median barrier 20. The second vertical brace 72 (FIG. 5, FIG. 6, FIG. 8B) proximate the first vertical brace 71 also serves as a non-adjustable spacer to sit against the surface of the permanent concrete median barrier 20. Vertical brace 72 extends beyond vertical brace 71 to compensate for the greater distance between the transition wall and the vertical brace 72. The third 73 and fourth 74 vertical braces (FIG. 3A, FIG. 5, FIG. 6, FIG. 7A, FIG. 8C) each serve as an adjustable brace, each having a brace plate 75 (shown in FIGS. 3A and 3B) connected to each of the third 73 and fourth 74 vertical braces to a brace plate jack screw 76 by a ball joint 77 allowing each brace plate 75 to move along the length of the brace plate jack screw 76 and the ball joint 77 allowing each brace plate 75 to be adjusted on the plane thereof. Each brace plate 75 is a flat square configuration made of HSS. In this embodiment, the size of each brace plate 75 is 300 mm by 300 mm by 19 mm thick. However, the brace plate may be of any size and shape that allows for transference of load during a collision or impact on the temporary transition barrier 10 from the transition wall 40 to the permanent concrete median barrier 20.

Figure 6:
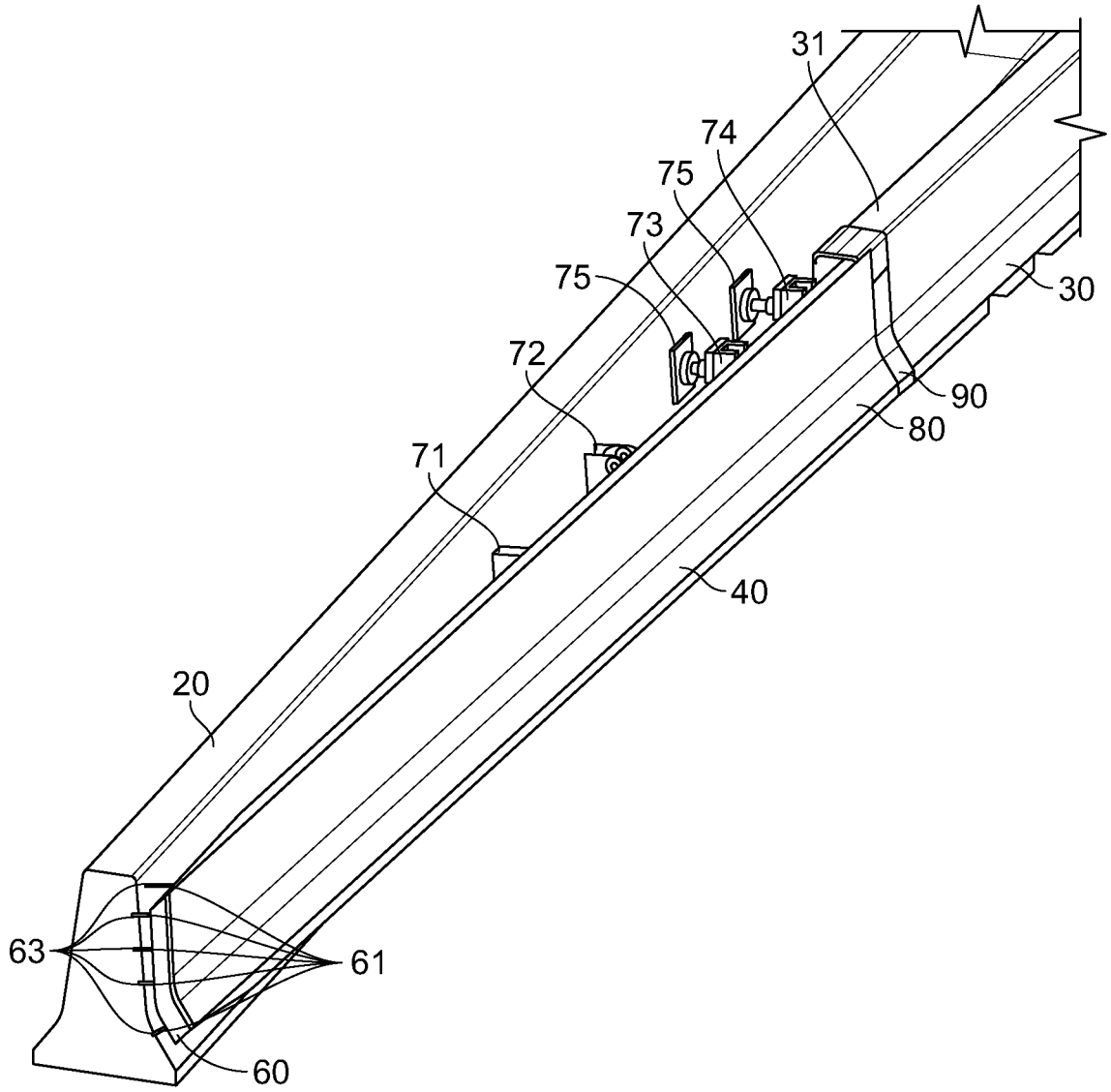
FIG. 6 is an end view of the transition barrier of FIG. 1 from the end of the permanent median barrier
Figure 7A:
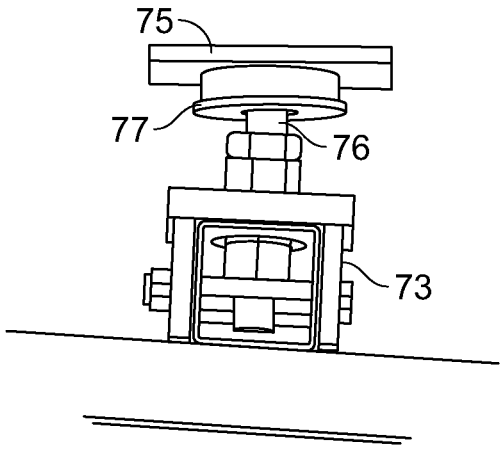
FIG. 7A is a top view of the adjustable spacer according to one embodiment
Figure 7B:
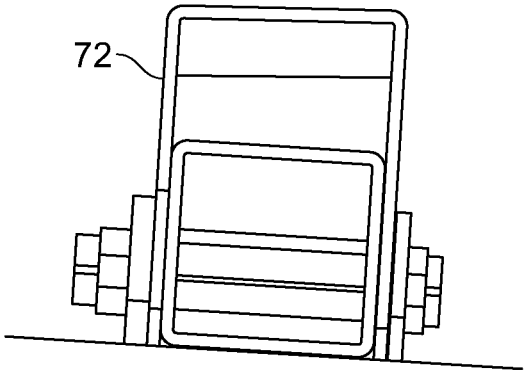
FIG. 7B is a top view of the fixed spacer according to one embodiment

The first end 60 of the transition wall 40 is attached to the surface of the permanent concrete median barrier 20 by a number of socket button head cap screws 61 and hardened flat washers with each screw having a hardened flat washer thereon. Each screw is then fastened in place in a complementary internal threaded insert 63 in the permanent concrete median barrier 20 (FIG. 6). The angle made between the fastened transition wall 40 and the permanent concrete median barrier 20 is about 3.1 degrees. However, the angle may differ depending on the specific need.

The second end 80 of the transition wall 40 is attached to the end 31 of the temporary median barrier 30 via steel shroud 90 enveloping the end 31 of the temporary median barrier 30 (See FIGS. 3A-3D). The steel shroud 90 facilitates the shape of the transition wall 40 is maintained and that separation of the transition wall 40 from the horizontal braces 50 and vertical braces 70 is minimized. The steel shroud 90 is connected to the inner profile of the transition wall via a steel shroud vertical brace 100. The steel shroud vertical brace 100 is similar in shape as the vertical braces 70. The steel shroud is connected to the steel shroud vertical brace 100 by a threaded cross bolt system 91. In this embodiment, the steel shroud is connected to the steel shroud vertical brace by a pair of threaded cross bolts. One end 92 of each threaded cross bolt is connected to the transition wall 40 with a threaded cross bolt nut 93. The second end 94 of each threaded cross bolt is connected to end 31 of the temporary median barrier 30 utilizing an x-type connection of the temporary median barrier 30 with a threaded cross bolt nut 93. A cup washer 95 is inserted into a complementary cross bolt void 96 found on the temporary median barrier 30 providing a bearing surface on the wall 40 further minimizing the temporary transition barrier 10 from separating from the temporary median barrier 30. The cup washer 95 has a low profile to minimize snagging of the sheet metal of a vehicle during impact.

Figure 9A:
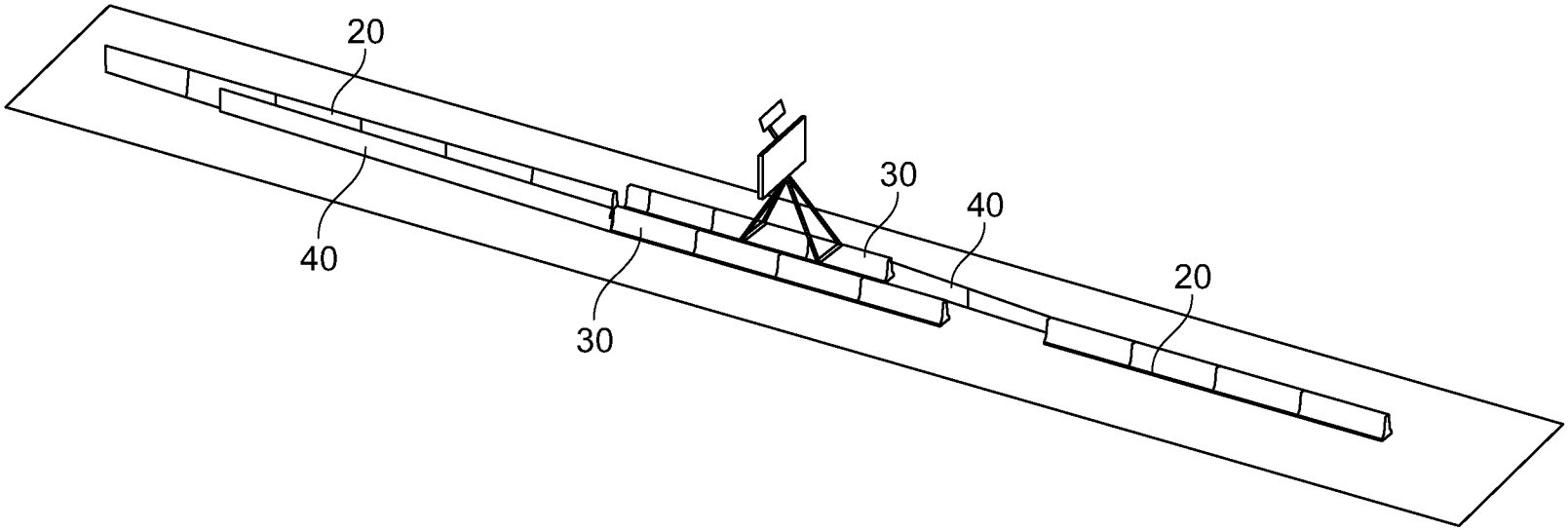
FIGS. 9A-9B are views of the temporary transition barrier of Example 1 in use with a sign support system
Figure 9B:
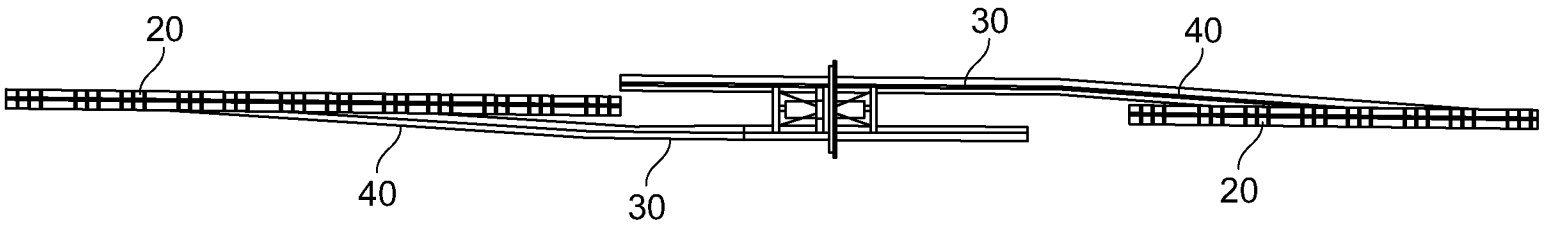
Figure 10A:
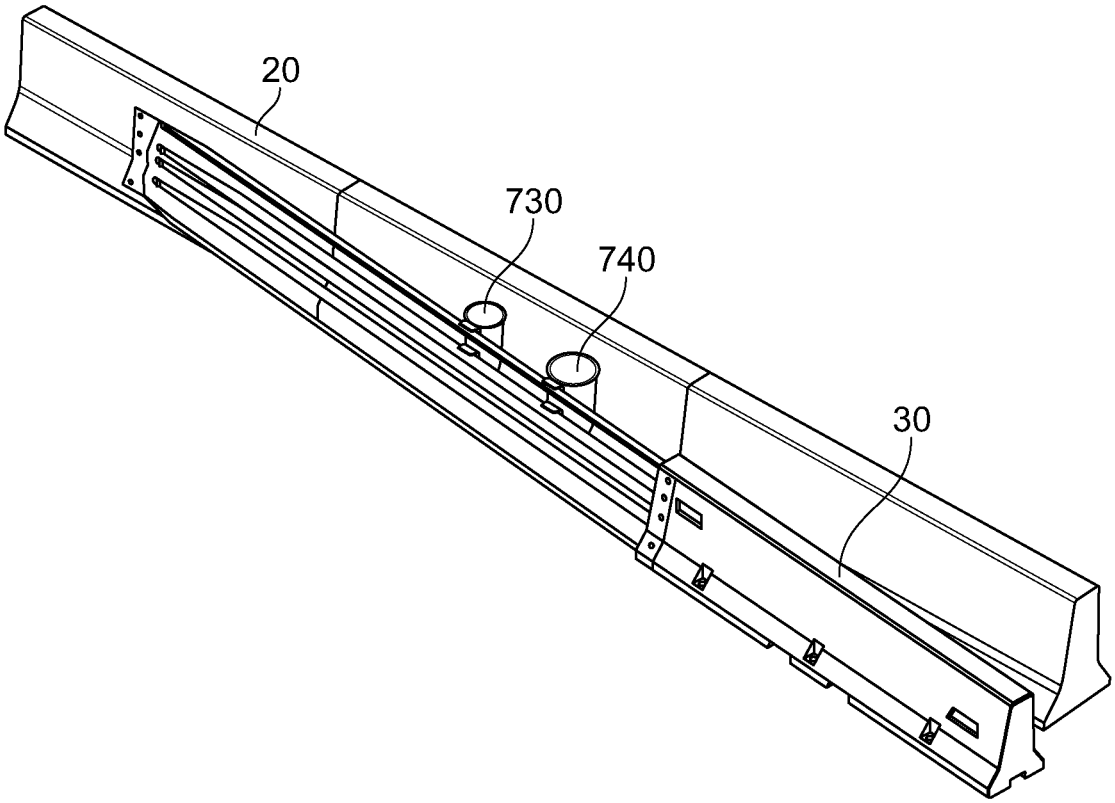
FIGS. 10A-10D are view of a transition barrier with spacers according to another embodiment
Figure 10B:
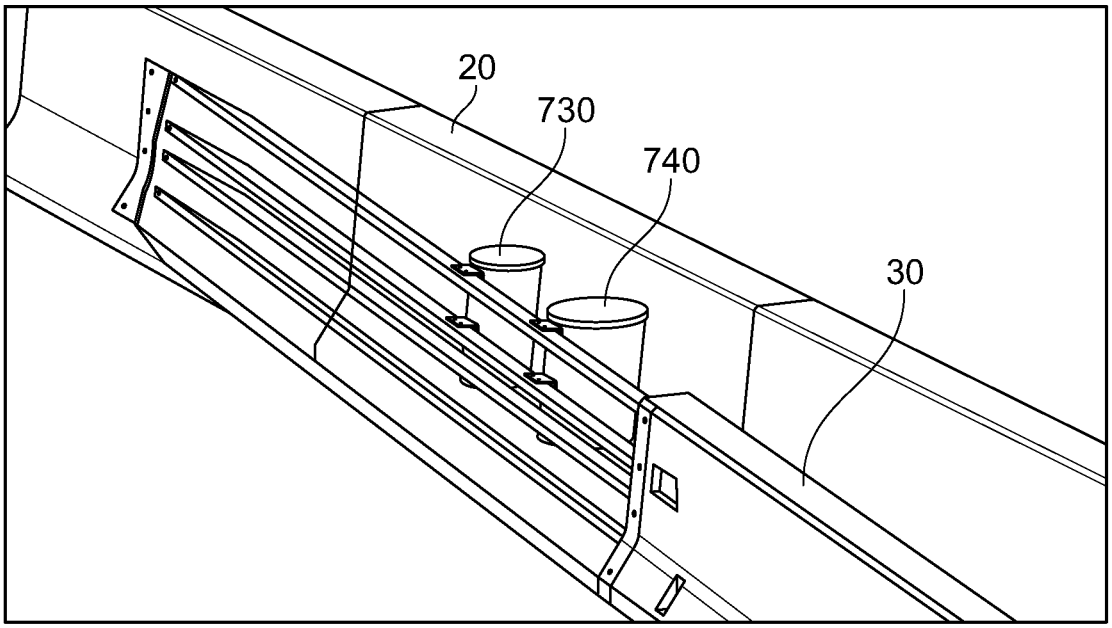
Figure 10C:
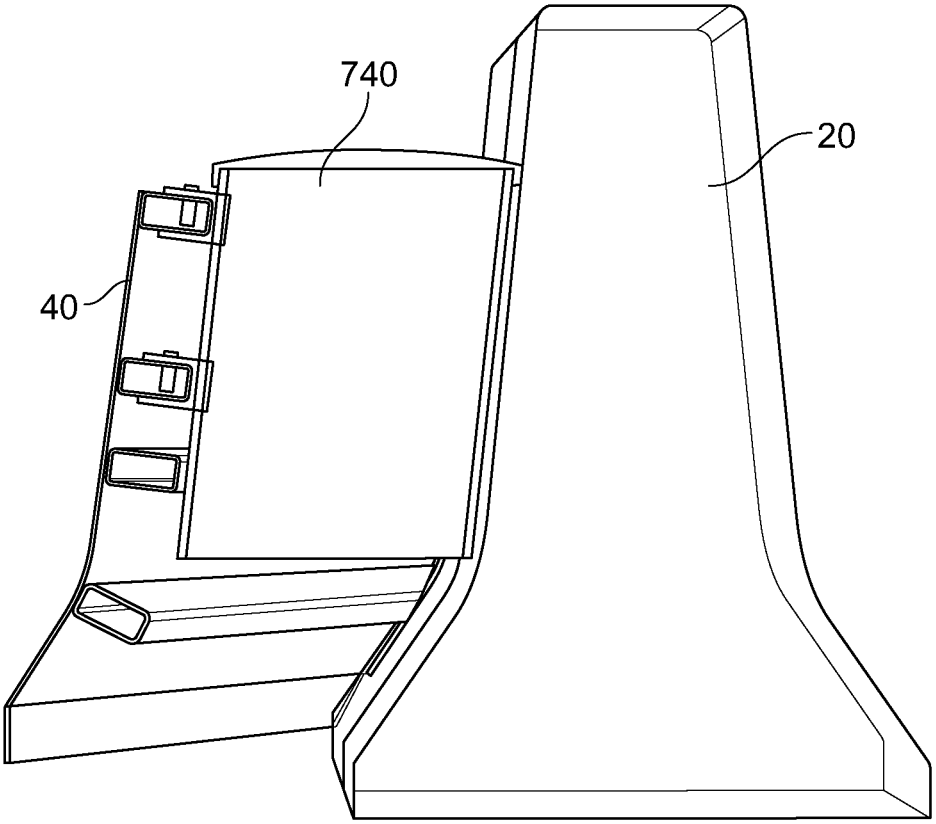
Figure 10D:
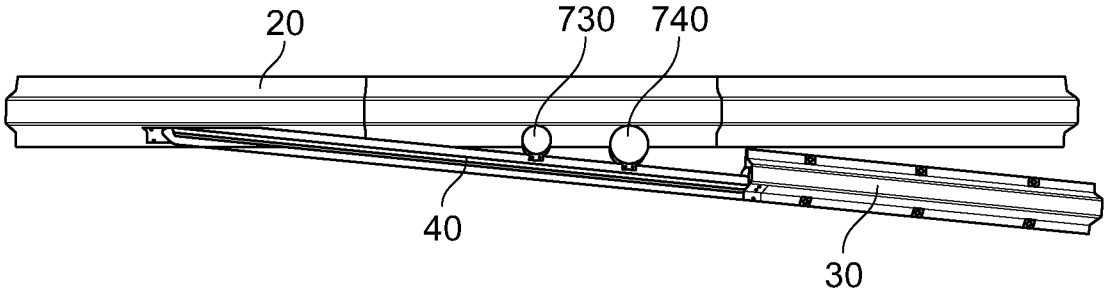

Referring now to FIGS. 9A and 9B, there is depicted a sign support system in use with the transition barrier wherein the sign support system is positioned and secured between parallel spaced apart temporary barriers 30. Barriers 30 are connected to permanent barriers 20 via transition wall 40.

Referring now to FIGS. 10A-10D, there is depicted a variant of the vertical spacers. In this instance, spacers 730 and 740 are tubes made of round steel section (with or without internal stiffeners) grade ASTM A500C or similar HSS or pipe grades. Each spacer is secured on a horizontal brace of the transition wall 40 via a nut and bolt system (or equivalent). Depending on the spacing between the transition wall 40 and the median barrier 20, each spacer 730 and 740 is positioned along the length of the horizontal brace to provide a snug fit between the transition wall 40 and the median barrier 20 while absorbing and transferring any load from the transition wall 40 to the median barrier 20 during impact or collision.

Figure 11:
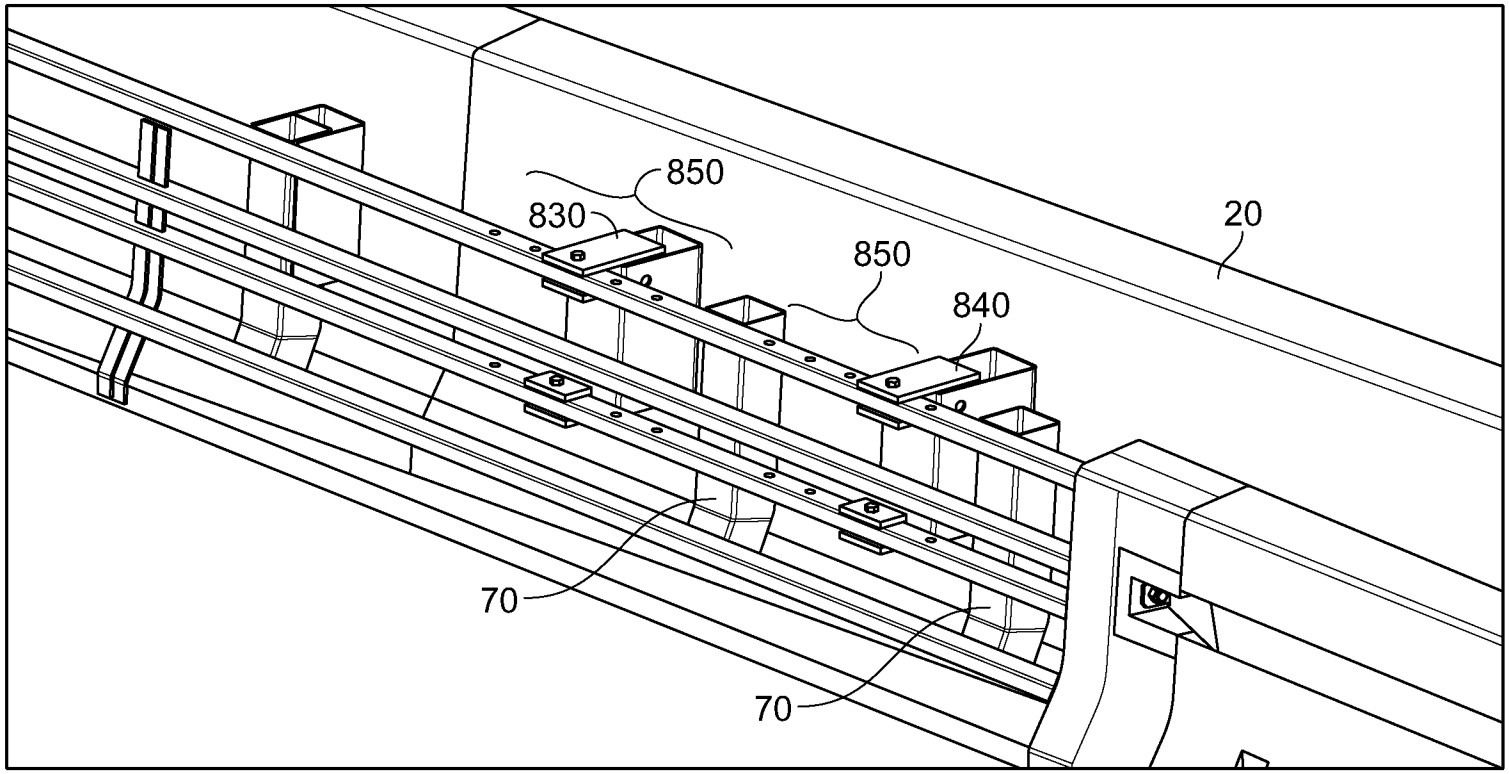
FIG. 11 is a view of the transition barrier with spacers according to another embodiment

Referring now to FIG. 11, there is depicted another variant of the vertical spacers. In this instance, spacers 830 and 840 are similar to spacer 72 of FIG. 7B, but the spacers 830 and 840 are adjustable along the horizontal brace by a spaced apart apertures 850 found along two horizontal braces. The spaced apart apertures 850 are situated along the portion of the horizontal braces between the vertical braces 70. The spacers 830 and 840 are each secured to the desired location by a threaded bolt and nut at the desired apertures 850.

The following are examples of a temporary transition barrier of the present disclosure undergoing MASH testing.

Example 1

Evaluation of the temporary transition barrier having a length of 10891.4 mm transitioning from a permanent 1049 mm Tall Wall New Jersey profile concrete median barrier to a temporary pinned-down, precast F-shape concrete barrier with a cross-bolt connection through MASH test 3-20.

The evaluation criteria for test MASH 3-20 includes assessing structural adequacy and occupant risk during impact by a test vehicle. Structural adequacy evaluation criteria includes the test article should contain and redirect the vehicle or bring the vehicle to a controlled stop; the vehicle should not penetrate, underride, or override the installation although controlled lateral deflection of the test article is acceptable (as per TABLE 5-1. A. Safety Evaluation Guidelines of the American Association of State Highway and Transportation Officials Manual for Assessing Safety Hardware 2009). Occupant risk evaluation criteria includes detached elements, fragments, or other debris from the test article should not penetrate or show potential for penetrating the occupant compartment, or present undue hazard to other traffic, pedestrians, or personnel in a work zone. Deformations of, or intrusions into, the occupant compartment should not exceed limits set forth in Section 5.3 as follows: roof ≤4.0 in. (102 mm), windshield-no tear of plastic liner and maximum deformation of 3 in. (76 mm), window-no shattering of a side window resulting from direct contact with a structural member of the test article (this requires the side windows to be in the up position for testing)-in cases where the windows are laminated, the guidelines for windshields will apply, wheel/foot well and toe pan areas ≤9 in. (229 mm), side front panel (forward of A-pillar)≤12 in. (305 mm), front side door area (above seat)≤9 in. (229 mm), front side door area (below seat)≤12 in. (305 mm), and floor pan and transmission tunnel areas ≤12 in. (305 mm); and Appendix E. (as per TABLE 5-1. D. Safety Evaluation Guidelines of the American Association of State Highway and Transportation Officials Manual for Assessing Safety Hardware 2009); the vehicle should remain upright during and after collision-the maximum roll and pitch angles are not to exceed 75 degrees (as per TABLE 5-1. F. Safety Evaluation Guidelines of the American Association of State Highway and Transportation Officials Manual for Assessing Safety Hardware 2009); Occupant impact velocities (OIV) maximum limit for the longitudinal and lateral component is 40 ft/s (12.2 m/s) (as per TABLE 5-1. H. Safety Evaluation Guidelines of the American Association of State Highway and Transportation Officials Manual for Assessing Safety Hardware 2009); and occupant ridedown acceleration maximum limit for longitudinal and lateral component is 20.49G (as per TABLE 5-1. I. Safety Evaluation Guidelines of the American Association of State Highway and Transportation Officials Manual for Assessing Safety Hardware 2009). The temporary pinned-down precast F-shape barrier branched off from the permanent 1049 mm Tall Wall New Jersey profile concrete median barrier until it became parallel to the permanent 1049 mm Tall Wall New Jersey profile concrete median barrier. A second row of the precast pinned barrier branched off on the opposite side of the permanent 1049 mm Tall Wall New Jersey profile concrete median barrier as shown in FIG. 8.

MASH test 3-20 involved impacting the temporary transition barrier at the critical impact point (CIP) with a small passenger vehicle (1100 kg test inertia mass) at a target impact speed and angle of 100 km/h and 25 degrees respectively, to the transition barrier. Actual impact speed and angle were within MASH specified tolerances. After the impact, the vehicle was successfully contained and redirected. The maximum occupant impact velocity (OIV) and the ridedown acceleration were within MASH specified tolerances. The temporary transition barrier complied with MASH 3-20.

Example 2

Evaluation of the temporary transition barrier having a length of 10891.4 mm transitioning from a permanent 1049 mm Tall Wall New Jersey profile concrete median barrier to a temporary pinned-down, precast F-shape concrete barrier with a cross-bolt connection through MASH test 3-21

The conditions of MASH test 3-21 were the same as MASH 3-20 save for the following:

MASH test 3-21 involves impacting the temporary transition barrier at the critical impact point (CIP) with a quad-cab pickup truck (2270 kg test inertia mass) at a target impact speed and angle of 100 km/h and 25 degrees respectively, to the transition barrier. Actual impact speed and angle were within MASH specified tolerances. After the impact, the vehicle was successfully contained and redirected. The maximum occupant impact velocity (OIV) and the ridedown acceleration were within MASH specified tolerances. The temporary transition barrier complied with MASH 3-21.

As many changes can be made to the preferred embodiments without departing from the scope thereof; it is intended that all matter contained herein be considered illustrative and not in a limiting sense.

The invention claimed is:

1. A transition barrier for transitioning from a permanent concrete barrier to a temporary concrete barrier, preventing a vehicle impacting said transition barrier from penetrating, underriding, overriding or overturning said transition barrier, said transition barrier comprising:

a) a first end; said first end being connectable to a surface of said permanent concrete barrier by a permanent concrete barrier connector;

b) a second end; said second end being connectable to an end of said temporary concrete barrier by a temporary concrete barrier connector;

c) a transition section defining an impact load receiving transition wall of a predetermined length between said first end and said second end; said transition wall comprising a steel plate having a top, bottom, front and a back;

d) at least one barrier brace proximate said transition wall, for supporting said transition wall; and e) at least one spacer, proximate the back of said transition wall for contact with a surface of said permanent concrete barrier, wherein said at least one spacer comprises a plurality of spacers, said plurality of spacers comprising a combination of fixed in length spacers and adjustable in length spacers; wherein said transition wall comprises a surface profile resembling that of said permanent concrete barrier.

2. The transition barrier of claim 1 providing for at least one of the following: i) containing and redirecting said vehicle impacting said transition barrier, ii) bringing said vehicle impacting said transition barrier to a controlled stop, and combinations thereof, said permanent concrete barrier being spaced apart from said temporary concrete barrier.

3. The transition barrier of claim 2 wherein said transition wall further comprising a shape of a profile of said permanent concrete barrier.

4. The transition barrier of claim 2 wherein said barrier brace is proximate said back of said transition wall.

5. The transition barrier of claim 1 wherein said transition wall further comprising a shape of a profile of said permanent concrete barrier.

6. The transition barrier of claim 5 wherein said barrier brace is proximate said back of said transition wall.

7. The transition barrier of claim 1 wherein said barrier brace is proximate said back of said transition wall.

8. The transition barrier of claim 7 wherein said at least one barrier brace runs a predetermined horizontal length of the transition wall.

9. The transition barrier of claim 8 wherein said at least one barrier brace runs a substantial horizontal length of the transition wall wherein a first end of said at least one barrier brace is proximate said first end of said transition barrier and a second end of said at least one barrier brace is proximate said second end of said transition barrier.

10. The transition barrier of claim 9 wherein said at least one barrier brace is a plurality of barrier braces running a predetermined horizontal length of the transition wall.

11. The transition barrier of claim 10 wherein said plurality of barrier braces are spaced apart from each other and are each integral with said back of said transition wall.

12. The transition barrier of claim 8 wherein said barrier brace has a position on said transition wall at a height between 16 to 20 inches from the ground, so as to be substantially equivalent to the height of a standard bumper of a vehicle.

13. The transition barrier of claim 1 wherein at least one of said plurality of spacers further comprises a contact plate for contacting said surface of said permanent concrete barrier.

14. The transition barrier of claim 1 wherein said permanent concrete barrier connector allows for an approach angle of from about 0 to about 10 degrees from centerline of said permanent concrete barrier.

15. The transition barrier of claim 14 wherein said approach angle is less than about 6 degrees.

16. The transition barrier of claim 14 wherein said approach angle is less than about 5 degrees.

17. The transition barrier of claim 14 wherein said approach angle is less than or equal to about 4 degrees.

18. The transition barrier of claim 1 wherein said permanent concrete barrier connector is at least one anchor.

19. The transition barrier of claim 18 wherein said at least one anchor is a concrete anchor.

20. The transition barrier of claim 1 wherein said permanent concrete barrier connector is a plurality of concrete anchors, each of said concrete anchors having a low-profile, non-snagging head for mitigating snagging of sheet metal of a vehicle during impact onto said temporary transition barrier.

21. The transition barrier of claim 20 wherein said temporary concrete barrier connector is at least one concrete anchor.

22. The transition barrier of claim 20 wherein said temporary concrete barrier connector is a plurality of concrete anchors.

23. The transition barrier of claim 1 wherein said temporary concrete barrier connector is at least one concrete anchor.

24. The transition barrier of claim 1 wherein said temporary concrete barrier connector is a plurality of concrete anchors.

25. The transition barrier of claim 1 wherein said barrier brace has a position on said transition wall at a height between 16 to 20 inches from the ground, so as to be substantially equivalent to the height of a standard bumper of a vehicle.

26. The transition barrier of claim 1 wherein at least one of said fixed in length spacers is proximate said first end of said transition barrier.

27. The transition barrier of claim 1 wherein at least one of said adjustable in length spacers is proximate said second end of said transition barrier.

28. The transition barrier of claim 27 wherein said spacer adjustable in length is adjustable to achieve a compression fit between the transition barrier and the permanent concrete barrier minimizing deflection during impact.

29. The transition barrier of claim 1 wherein said spacer adjustable in length is adjustable to achieve a compression fit between the transition barrier and the permanent concrete barrier minimizing deflection during impact.

30. The transition barrier of claim 1 wherein said transition barrier is configured for temporary use.

31. The transition barrier of claim 1 wherein said transition barrier contains and redirects a vehicle impacting said transition barrier and/or brings the vehicle to a controlled stop wherein the transition barrier mitigates said vehicle from flip over.

32. The transition barrier of claim 1 wherein the permanent concrete barrier is a permanent concrete median barrier and the temporary concrete barrier is a temporary concrete median barrier.

33. A method of forming a transition barrier between two spaced apart concrete barriers, said method comprising:

i) connecting a first end of said transition barrier of claim 1 to a first concrete barrier; and ii) connecting a second end of said transition barrier of claim 1 to an end of a second concrete barrier, forming a transition barrier between said two spaced apart concrete barriers.

34. The method of claim 33 wherein said first concrete barrier is a permanent concrete barrier and said second concrete barrier is a temporary concrete barrier.

* * * * *